US009649628B2

(12) United States Patent
Dudek

(10) Patent No.: US 9,649,628 B2
(45) Date of Patent: May 16, 2017

(54) PIPETTING SYSTEM WITH IMPROVED CONTROL AND VOLUME ADJUSTMENT

(71) Applicant: GILSON SAS, Villiers-le-Bel (FR)

(72) Inventor: Bruno Dudek, Montgresin (FR)

(73) Assignee: Gilson SAS, Villiers le Bel (FR)

( * ) Notice: Subject to any disclaimer, the term of this patent is extended or adjusted under 35 U.S.C. 154(b) by 0 days.

(21) Appl. No.: 14/781,569

(22) PCT Filed: Apr. 1, 2014

(86) PCT No.: PCT/EP2014/056533
§ 371 (c)(1),
(2) Date: Sep. 30, 2015

(87) PCT Pub. No.: WO2014/161857
PCT Pub. Date: Oct. 9, 2014

(65) Prior Publication Data

US 2016/0059229 A1 Mar. 3, 2016

(30) Foreign Application Priority Data

Apr. 4, 2013 (FR) ..... 13 53039

(51) Int. Cl.
*B01L 3/02* (2006.01)

(52) U.S. Cl.
CPC ..... *B01L 3/0224* (2013.01); *B01L 3/0227* (2013.01); *B01L 2200/0605* (2013.01); *B01L 2400/0478* (2013.01)

(58) Field of Classification Search
CPC ..... B01L 3/02; B01L 3/0224; B01L 3/0227; B01L 2400/0478; B01L 2200/0605
See application file for complete search history.

(56) References Cited

U.S. PATENT DOCUMENTS 2,826,339 A 3/1958 Mailard
2,946,486 A * 7/1960 Gilmont ..... B01L 3/0224 222/288

(Continued)

FOREIGN PATENT DOCUMENTS

EP 0547503 6/1993
EP 1344565 A1 9/2003

(Continued)

OTHER PUBLICATIONS

French Preliminary Search Report mailed Dec. 12, 2013 for related French Application No. 1353039.

(Continued)

*Primary Examiner* — Brian R Gordon
(74) *Attorney, Agent, or Firm* — Miles & Stockbridge P.C.

(57) ABSTRACT

A device for controlling pipetting and adjusting a volume to be sampled, including a pipetting control member; rotary actuating means coupled to the control member; a linking member slidably mounted on the actuating means, the linking member being connected to a piston; volume adjusting means; rotary means defining, for the linking member, a spiral-shaped guiding path, the rotary means being coupled to the adjusting means so that their actuation causes a rotation of the means about a second axis which the guiding path is centered, this rotation leading to a displacement of the linking member along the path, and to a sliding of the member relative to the actuating means.

12 Claims, 4 Drawing Sheets

(56) References Cited

U.S. PATENT DOCUMENTS 4,096,751 A * 6/1978 Withers ..... B01L 3/0224 222/43
4,228,831 A * 10/1980 Kerns ..... G01N 35/1009 141/27
4,527,437 A * 7/1985 Wells ..... B01L 3/021 222/214
4,760,939 A * 8/1988 Ball ..... B67D 1/102 222/23
4,929,428 A * 5/1990 Tezuka ..... G01F 11/021 422/515
5,330,721 A * 7/1994 Tervamaki ..... B01L 3/0234 422/515
5,406,856 A * 4/1995 Kuhn ..... B01L 3/0279 73/864.11
5,879,633 A * 3/1999 Tervamaki ..... B01L 3/0234 422/516
5,970,806 A 10/1999 Telimaa et al.
6,428,750 B1 * 8/2002 Rainin ..... B01L 3/0224 222/154
6,455,006 B1 * 9/2002 Mukai ..... B01L 3/0224 422/501
7,988,934 B2 * 8/2011 Balmer ..... G01N 35/0099 422/501
8,029,742 B2 * 10/2011 Butz ..... B01L 3/0217 422/501
2013/0291660 A1 * 11/2013 Wilmer ..... B01L 3/021 73/864.13

FOREIGN PATENT DOCUMENTS

EP 1559480 A1 8/2005
JP 62-43634 U 3/1987

OTHER PUBLICATIONS

International Search Report mailed Jun. 6, 2014 for related PCT Application No. PCT/EP2014/056533.
French Preliminary Search Report mailed Dec. 17, 2014 for French Application No. 1453185.
International Search Report mailed Jun. 10, 2015 for PCT Application No. PCT/EP2015/057788.

* cited by examiner

PIPETTING SYSTEM WITH IMPROVED CONTROL AND VOLUME ADJUSTMENT

The present invention relates to the field of air displacement pipetting. It more particularly relates to a device for controlling pipetting and adjusting a volume to be sampled.

The invention applies to the different types of sampling systems, that is in particular the hand- or power-operated pipettes, as well as automatons. Pipettes, also referred to as sampling pipettes, laboratory pipettes or even liquid transfer pipettes, represent a privileged application. They are intended for removing and dispensing liquid into containers or the like.

Hand-operated pipettes are intended to be handheld by an operator during the liquid sampling and dispensing operations, these operations being performed by moving a control knob by applying an axial pressure on the same knob. The axial pressure applied to the control knob is transmitted to a piston of the pipette, which undergoes an axial displacement and causes an air displacement leading to the sampling and dispensing operations. For power-operated pipettes, if the sampling stroke and dispensing stroke commands are also controlled by actuating a knob, the displacement of the piston is performed on the other hand due to an engine driven by an electronic device.

On the hand-operated pipettes, in order to be able to adapt the volume quantity to pipette, means for adjusting this volume are generally provided. By actuating these means, the initial position of the piston is displaced, and the pipetting stroke of the piston is thus modified. Therefore, during the pipetting operations, the displacement of the control knob to be performed by the operator is not the same when the volume to be sampled changes. Problems of pipetting comfort can result therefrom, in particular for the low strokes associated with the sampling of small liquid volumes.

On the power-operated pipettes and automatons, variable amplitude displacements of the control member, which depend on the volume to be sampled, complicate the engines and their electronic control systems.

Therefore, whatever the type of air displacement pipetting system, there is a need for optimizing its device for controlling pipetting and adjusting the volume to be sampled.

To do so, the object of the invention is a device for controlling pipetting and adjusting a volume to be sampled, for an air displacement pipetting system, said device comprising:

- a translation displaceable pipetting control member;
- rotary actuating means coupled to the control member so that a translation displacement thereof causes a rotation of the actuating means about a first rotation axis;
- a linking member slidably and movably mounted on the actuating means, the linking member being intended to be connected to a piston of the pipetting system;
- means for adjusting the volume to be sampled;
- rotary means defining, for the linking member, a spiral-shaped guiding path, said rotary means being coupled to said adjusting means so that the actuation of the latter causes a rotation of the rotary means about a second rotation axis parallel to the first axis and on which the spiral guiding path is centred, this rotation simultaneously leading to a relative displacement of the linking member along the spiral guiding path, and to a sliding of the linking member relative to said actuating means.

The invention is noteworthy in that it provides the implementation of a spiral-shaped guiding path of the linking member, adapted to adjust the volume to be sampled while enabling a constant pipetting stroke to be maintained, whatever the sampled volume.

In the case of a hand-operated pipette, this improves the pipetting comfort since the operator can repeat the same pipetting stroke for all the sampled volumes. In the case of a power-operated pipette or an automaton, due to the identical pipetting stroke for all the volumes, the engines and their electronic control systems implemented for the displacement of the pipetting control member can be simplified. A gain regarding the cost of the pipetting system advantageously results therefrom.

Finally, the spiral shape of the path guiding the linking member enables the latter to draw a substantially circular movement which is particularly reliable, and hardly subject to errors and blocking risks. It also enables a great pipetting accuracy to be provided to the system.

Preferably, said actuating means comprise a toothed segment cooperating with a rack made on the pipetting control member. Other coupling means can however be worth considering, such as friction means, without departing from the scope of the invention.

Preferably, said actuating means comprise a finger provided with a groove in which the linking member is slidably mounted.

Preferably, the linking member is a pin.

Preferably, said first and second rotation axes are substantially merged. Alternatively, they could be made parallel, at a distance from one another, without departing from the scope of the invention.

Preferably, said volume adjusting means are rotary.

Preferably, the adjusting means comprise a worm screw cooperating with a helical toothing provided on the rotary means. These adjusting means are distinct from the control member, even if designed intertwining these two elements can be chosen, for example by arranging them coaxially one around the other.

Preferably, in a top position of the control member, the sliding axis of the linking member is parallel to a translation axis of the control member. In other words, upon actuating the volume adjusting means, sliding the linking member relative to said actuating means is performed along an axis parallel to the translation axis of the control member, which is generally parallel to the sliding axis of the piston of the pipetting system.

Preferably, switching form the top position of the control member to its low position causes a rotation of the actuating means at an angle substantially equal to 180°. A lower angle is of course worth considering, without departing from the scope of the invention.

Preferably, the guiding path has a number of turns equal to or greater than two, and even more preferentially equal to or greater than four. However, other possibilities can be worth considering, such as a single turn, or even an incomplete turn.

Preferably, the rotary means take the shape of a disk inside which the spiral guiding path is made in a through way.

The object of the invention is also an air displacement pipetting system, comprising a device for controlling pipetting and adjusting a volume to be sampled such as described above.

Preferably, the pipetting system includes a slidably mounted piston as well as means for connecting the piston to said linking member. Preferably, blade- or elastic rod-type means are chosen, but any of other mean can be worth considering, enabling the spiral movement of the linking member moving in the spiral path to be transmitted, into a sliding movement of the piston during pipetting. It can be for example alternatively one or several hinged connecting rods.

Preferably, the system is a hand- or power-operated pipette, including a handle forming top part fitted with the rod-shaped control member, at the end of which a control knob is provided.

Alternatively, the pipetting system is an automaton.

Further advantages and characteristics of the invention will appear upon reading a non-limiting detailed description hereinbelow.

The description will be made with reference to the appended drawings among which:

Figure 5A:
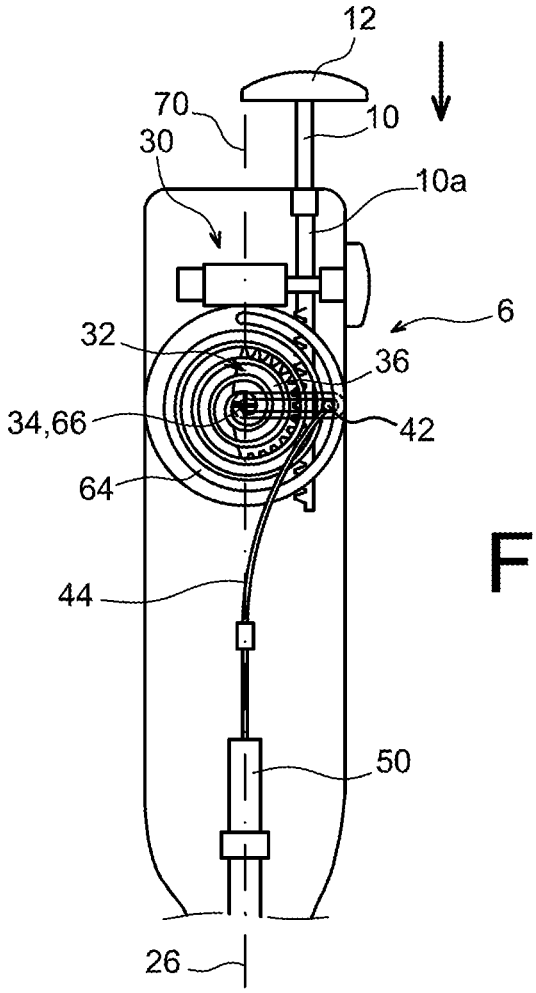
Figure 5B:
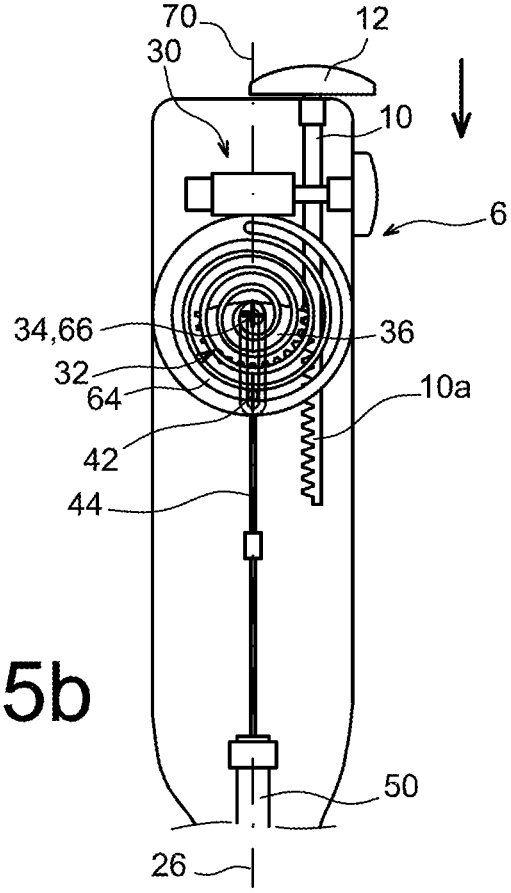
Figure 6A:
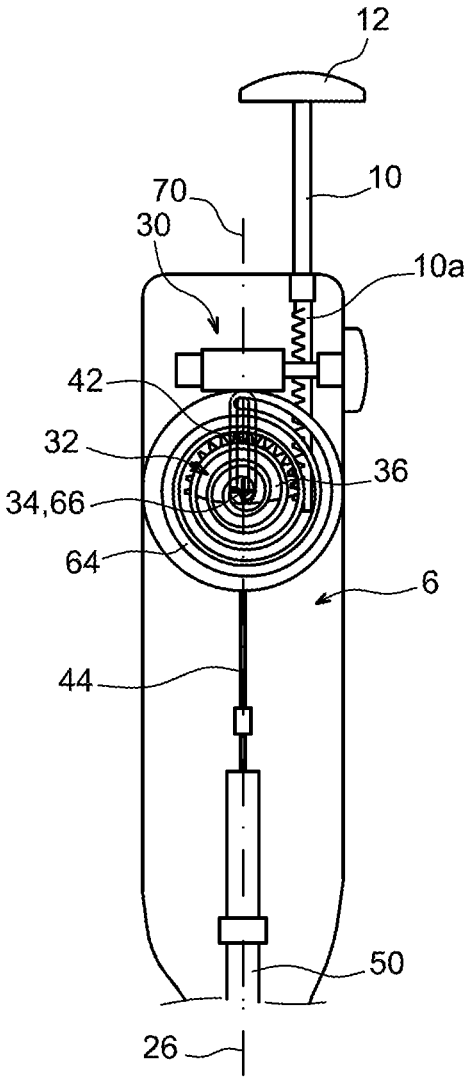
Figure 6B:
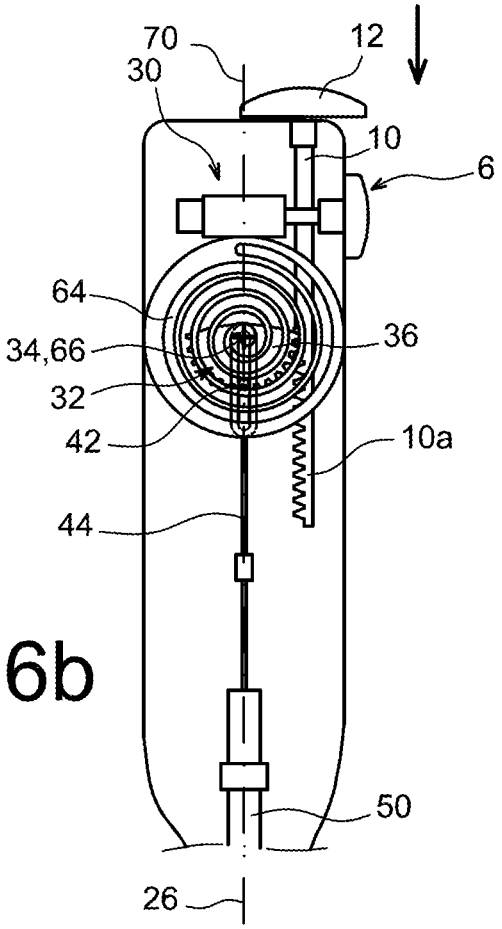

FIGS. 5*a* and 5*b* shown the pipette in different successive states during a pipetting operation; and FIGS. 6*a* and 6*b* are analogous views to those of FIGS. 5*a* and 5*b*, with the pipette adjusted to sample a different liquid volume.

Figure 1:
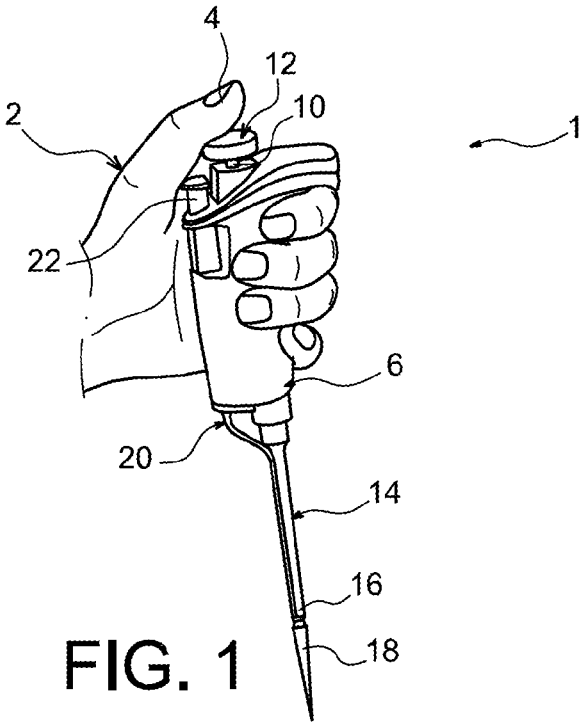
FIG. 1 shows a perspective view of an air displacement sampling pipette, according to a preferred embodiment of the present invention.

With reference first to FIG. 1, a hand-operated air displacement sampling pipette 1 is represented, according to a preferred embodiment of the present invention. Throughout the following description, the terms "top" and "low" are to be considered with the pipette held vertically, in a pipetting position or close to this same position.

In FIG. 1, the pipette 1 is shown held by the hand 2 of an operator, who, thanks to his/her thumb 4, actuates the pipette to produce the dispensing of a liquid which has been previously drawn.

More precisely, the pipette 1 comprises a handle 6 forming the upper body of the pipette, handle from which a rod-shaped pipetting control member 10 emerges carrying at its top end, in a pipetting position, a control knob 12 the upper part of which is intended to undergo the pressure of the operator's thumb. By way of indication, it is noted that a display screen (not represented) can be provided on the handle 6. Also, as mentioned thereafter, means for adjusting the volume to be sampled can also be accessed by the operator on this handle 6.

Under the handle 6, the pipette 1 includes a removable low part 14, which ends towards the bottom by a cone-holder cap 16 receiving a consumable 18, also referred to as a sampling cone. In a known manner, after pipetting, the cone can be mechanically ejected by an ejector 20 the actuating knob 22 of which is for example protruding on the top of the handle, close to the control knob 12.

Figure 2:
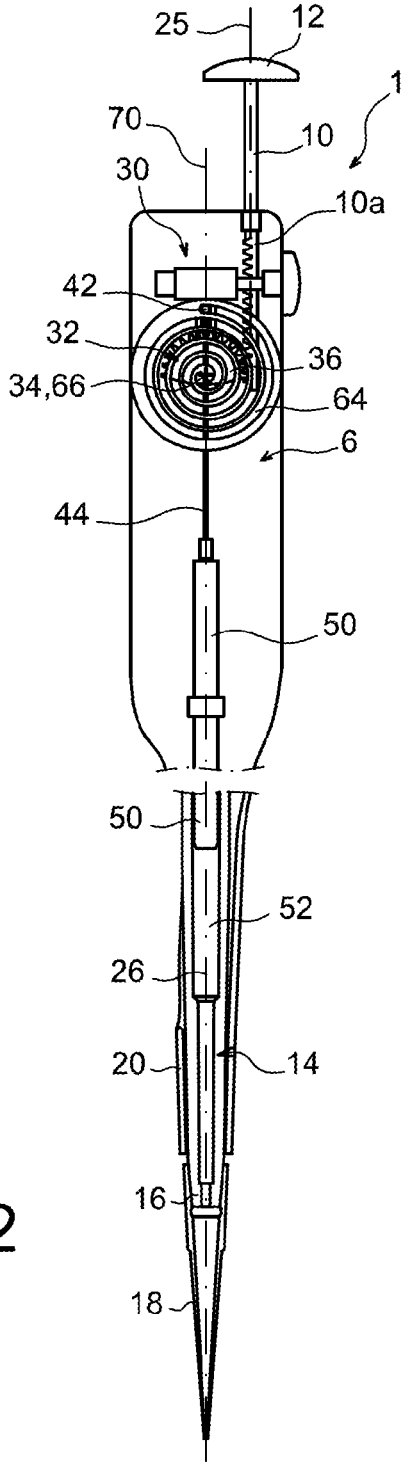
FIG. 2 shows a schematic cross-section view of the pipette shown in FIG. 1.

In FIG. 2, the pipette 1 is schematically shown, with its device 30 for controlling pipetting and adjusting the volume to be sampled, integrated into the handle 6. This device 30, specific to the present invention, will be described in a more detailed way thereafter. The piston 50 of the pipette is also shown, which enables the air displacement necessary to the sampling operations to be generated. The piston 50 is slidably movable along a vertical axis 26, in a suction chamber 52 defined inside the low part 14. The axis 26 corresponds to the longitudinal axis of the pipette, on which a high number of components, such as the cone 18 are centred.

Figure 3:
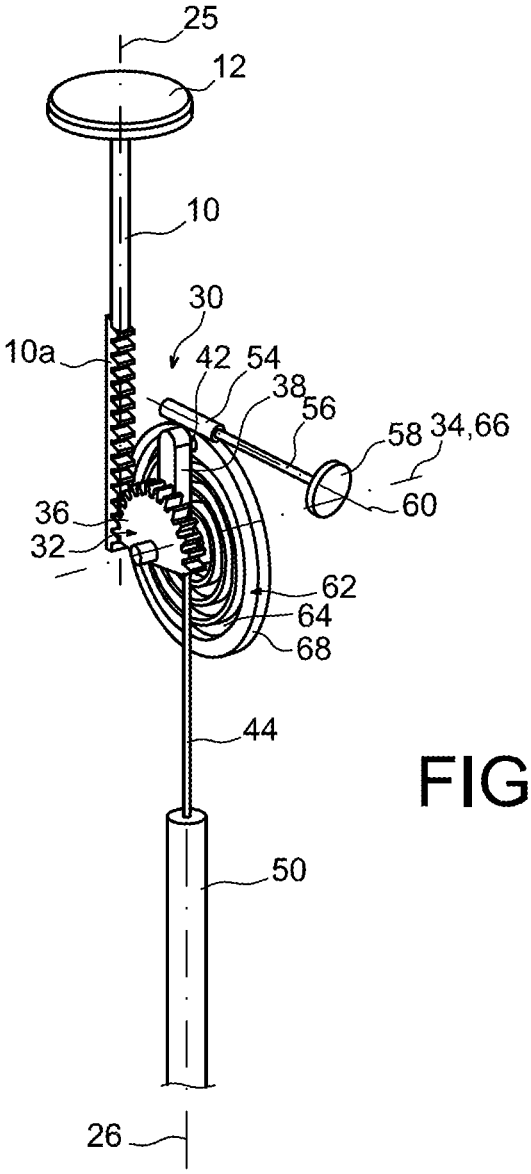
FIG. 3 shows a perspective view of the device for controlling pipetting and adjusting the volume to be sampled of the pipette shown on the previous figures.
Figure 4:
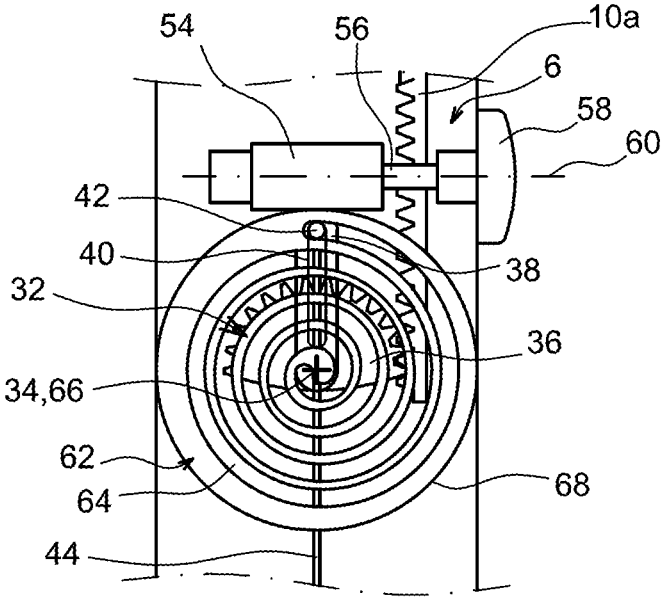
FIG. 4 shows an enlarged view of a part of the device of the previous figure.

With reference jointly to FIGS. 2 to 4, the device 30 for controlling pipetting and adjusting the volume to be sampled is shown. The device first includes the rod-shaped control member 10, translation displaceable relative to the handle 6, along a translation axis 25 parallel to the axis 26. At its low end, the rod 10 has a rack 10*a*.

The device 30 also includes rotary actuating means 32, rotatably mounted relative to the handle 6 about a first rotation axis 34 preferably orthogonal to the axes 25, 26. The means 32 have a toothed segment 36 meshing the rack 10*a*, as can be seen especially in FIG. 3. Consequently, a translation of the rod 10 along the axis 25 causes a rotation of the means 32 about the axis 24. Here, the segment 36 corresponds to a disk segment of about 180°.

The means 32 also include a finger 38 rotatably engaged with the segment 36, the finger being arranged in a plane orthogonal to the first rotation axis 34 and extending along a direction cutting off this same axis 34. As can be seen in FIG. 4, the finger 38 is fitted with a straight groove 40 extending along the longitudinal direction of this finger. Within the groove 40, a pin-shaped linking member 42 is freely slidably mounted. The pin 42 is provided to be connected to the piston 50 in order to apply thereto the raising/lowing movements necessary to the pipetting operations. To do so, an elastic rod or blade 44 is provided, the top end of which is mounted on the pin 42 and the low end of which is mounted on the top end of the piston 50.

The device 30 also includes means for adjusting the volume to be sampled. These are rotary means provided with a worm screw 54 extended by a shaft 56 inside which an adjusting knob 58 distinct from the pipetting control knob 12 is located. The adjusting knob 58 is controllable from the outside of the handle 6. These adjusting means are arranged along an axis 60 orthogonal to each of the axes 34, 26.

Finally, the device 30 comprises rotary means 62 having the overall shape of a disk defining, for the linking member, a spiral-shaped guiding path 64. The path 64 then takes the shape of a through groove or throat, into which the pin 42 is guided. In this respect, the diameter of the pin is substantially identical to the width of the groove/throat extending as a spiral, preferably as a spiral of Archimedes. The number of turns of the path 64 is for example between 2 and 6. This spiral is centred on a second rotation axis 66, which is preferably substantially merged with the first abovementioned rotation axis. This axis 66 corresponds to the one of the disk 62 which therefore lies within a plane parallel to the axes 25, 26.

The disk 62 has at its periphery 68 a helical toothing (not shown) meshing with the worm screw 54. For this reason, the disk is coupled to the volume adjusting means so that actuating the latter into rotation causes a rotation of the disk 62 about the second rotation axis 66.

In FIGS. 5*a* and 5*b*, a part of the pipette 1 is shown in different states during a lowering operation of the piston 50. This lowering operation is the one performed prior to sampling liquid, or corresponds to the liquid dispensing operation performed after sampling.

To fulfil such an operation, the operator actuates the control knob 12 to cause the lowering of the rod 10. During this lowering, the meshing between the rack 10*a* and the toothed segment 36 leads to the rotation of the means 32 about the axis 34. During this rotation maintained by the lowering of the rod 10, a relative displacement of the pin 42 along the spiral guiding path 64 provided on the disk 62 remaining fixed, as well as a sliding of this pin in the groove 40 simultaneously take place. This sliding is necessary to cope with the gradual evolution of the diameter of the turn in which the pin 42 is guided during the lowering operation.

During the lowering of the control rod 10, the pin 42 is displaced along the path 64 starting from a top point relative to the pipette body, towards a low point, by following a spiral trajectory. For this reason, during the lowering, the pin 42 also deviates from the axis 26 on which it was initially placed with the control rod at a top position, which leads the blade 44 to be elastically bending deformed. This blade then drives the sliding movement towards the bottom of the piston 50.

In the represented embodiment, a complete lowering stroke of the piston is achieved by a complete downwards stroke of the control rod 10, leading to the rotation of the toothed segment 36 at an angle of about 180°. Further, at the end of the lowering stroke, the pin 42, after deviating from the axis 26, returns to a low position by being again arranged on this same axis. During this stroke, the pin 42 therefore travels along a half-turn of the spiral 64.

Raising the equipment is then made conventionally, by releasing the control knob 12 and under the action of return springs (not shown). This raising, made for example for sampling liquid, is then following by a new downwards stroke for dispensing the sampled liquid.

In FIGS. 6*a* and 6*b*, the pipette 1 is also shown respectively at the beginning and the end of the piston lowering operation, but with a different sampling volume. To adapt the volume, the adjusting knob 58 is rotated, leading to a rotation of the disk 62 with the actuating means 32 remaining fixed. Here again, this rotation simultaneously leads to a relative displacement of the pin 42 along the spiral guiding path 64, and to a sliding of this pin in the groove 40. During this sliding, the pin then tends to be displaced upwards or downwards as a function of the direction of rotation, driving with itself the piston 50 the top position of which varies according to the same amplitude.

In a top position of the control member 10 such as represented in FIG. 6*a*, the sliding axis 70 of the pin 42 is preferably provided to be substantially merged with the axis 26. This axis 70, corresponding to the longitudinal direction of the groove 40, is thus arranged so that actuating the adjusting knob 58 causes the pin 42 to be displaced along a vertical diameter of the spiral, while remaining on the axis 26. By way of indicating example, in FIG. 6*a*, the represented adjustment is achieved thanks to two complete revolutions of the disk 62 with respect to the position for sampling a maximum volume represented in FIG. 2.

Also, during a lowering operation performed from the adjustment of FIG. 6*a*, a complete stroke of the control rod 10 leads the actuating means 32 to pivot on about 180°, as in each of all the other positions for adjusting the volume to be sampled. The pin 42 is thus displaced along the path 64 starting from a top point relative to the pipette body, towards a low point, by following a spiral trajectory which deviates it from the axis 26 before meeting it again at the low point, as shown in FIG. 6*b*.

In the example shown in FIGS. 6*a* and 6*b*, the rotation of about 180° of the pin 42 being performed closer to the rotation axis 34 than in the configuration shown in FIGS. 5*a* and 5*b*, the displacement of this pin 42 and of the piston 50 along the axis 26 is smaller. This thus makes it possible to sample a less significant liquid volume.

The invention thus advantageously enables different liquid volumes to be reliably and accurately sampled, while maintaining a substantially identical pipetting stroke.

It is noted that the above-described device 30 can have a disengageable aspect, enabling the implementation of a draining operation of the pipette after dispensing.

Of course, various modifications can be brought by those skilled in the art to the invention which has been described, solely by means of non-limiting examples. In particular, the invention can be applied to a power-operated pipette or to an automaton for which the translation displacement of the control member is performed via an engine.

The invention claimed is:

1. A device for controlling pipetting and adjusting a volume to be sampled, for an air displacement pipetting system, said device comprising:
- a translation displaceable pipetting control rod;
- rotary gear coupled to the control rod such that a translation displacement of the control rod causes a rotation of the rotary gear about a first rotation axis;
- a linking pin slidably and movably mounted on the rotary gear, the linking pin being adapted to be connected to a piston of the pipetting system;
- an adjusting screw for adjusting the volume to be sampled; and
- a rotary disk which defines, for the linking pin, a spiral-shaped guiding path, said rotary disk being coupled to said adjusting screw such that actuation of the adjusting screw causes a rotation of the rotary disk about a second rotation axis parallel to the first rotation axis and on which the spiral-shaped guiding path is centered, said rotation of the rotary disk simultaneously causes relative displacement of the linking pin along the spiral-shaped guiding path, and sliding of the linking pin relative to said rotary gear.

2. The device according to claim 1, wherein said rotary gear comprises a toothed segment cooperating with a rack disposed on the pipetting control rod.

3. The device according to claim 1, wherein said rotary gear comprises a finger provided with a groove in which the linking pin is slidably mounted.

4. The device according to claim 1, wherein said first and second rotation axes are substantially collinear.

5. The device according to claim 1, wherein the adjusting screw comprises a worm screw cooperating with a helical toothing provided on the rotary gear.

6. The device according to claim 1, wherein, in a top position of the control rod, the sliding axis of the linking pin is parallel to a translation axis of the control rod.

7. The device according to claim 6, wherein switching from the top position of the control rod to a low position causes a rotation of the rotary gear at an angle substantially equal to 180°.

8. The device according to claim 1, wherein the guiding path has a number of turns equal to or greater than two.

9. The pipetting system according to claim 8, wherein the guiding path has a number of turns equal to or greater than four.

10. An air displacement pipetting system comprising:
- a device for controlling pipetting and adjusting a volume to be sampled, said device comprising:
  - a translation displaceable pipetting control rod;
  - a rotary actuating gear coupled to the control rod such that a translation displacement thereof causes a rotation of the rotary actuating gear about a first rotation axis;
  - a linking pin slidably and movably mounted on the rotary gear, the linking pin being adapted to be connected to a piston of the pipetting system;

an adjusting screw for adjusting the volume to be sampled; and a rotary disk which defines, for the linking pin, a spiral-shaped guiding path, said rotary disk being coupled to said adjusting screw such that actuation of the adjusting screw causes a rotation of the rotary disk about a second rotation axis parallel to the first rotation axis and on which the spiral-shaped guiding path is centered, said rotation of the rotary disk simultaneously causes a relative displacement of the linking pin along the spiral-shaped guiding path, and sliding of the linking pin relative to said rotary actuating gear, wherein said pipetting system is a hand- or power-operated pipette, including a handle-forming top part fitted with a stem having a control knob at one end.

11. The pipetting system according to claim 10, further comprising a slidably mounted piston connected to said linking pin.

12. The pipetting system according to claim 10, wherein said pipetting system further comprises a motor for causing translational displacement of the translation displaceable pipetting control rod.

* * * * *